US011396872B2

(12) United States Patent
Yamada et al.

(10) Patent No.: US 11,396,872 B2
(45) Date of Patent: Jul. 26, 2022

(54) AXIAL PISTON-TYPE HYDRAULIC ROTARY MACHINE

(71) Applicant: Hitachi Construction Machinery Co., Ltd., Tokyo (JP)

(72) Inventors: Tsuyoshi Yamada, Tsukuba (JP); Yoshitomo Yabuuchi, Kasumigaura (JP); Naoyuki Okuno, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 657 days.

(21) Appl. No.: 16/330,428

(22) PCT Filed: Nov. 3, 2017

(86) PCT No.: PCT/JP2017/039839
§ 371 (c)(1),
(2) Date: Mar. 5, 2019

(87) PCT Pub. No.: WO2018/163504
PCT Pub. Date: Sep. 13, 2018

(65) Prior Publication Data

US 2021/0277891 A1 Sep. 9, 2021

(30) Foreign Application Priority Data

Mar. 10, 2017 (JP) ..... JP2017-045920

(51) Int. Cl.
*F04B 53/16* (2006.01)
*F04B 1/2035* (2020.01)
(Continued)

(52) U.S. Cl.
CPC ..... *F04B 53/166* (2013.01); *C23C 8/24* (2013.01); *F04B 1/2035* (2013.01);
(Continued)

(58) Field of Classification Search
CPC .... F04B 53/166; F04B 1/2064; F04B 1/2035; F04B 1/2078; F04B 1/12; F04B 39/122;
(Continued)

(56) References Cited

U.S. PATENT DOCUMENTS

2008/0047424 A1* 2/2008 Hirota ..... F04B 27/109 92/68
2012/0183419 A1* 7/2012 Kobayashi ..... F04B 39/122 417/415
2015/0300333 A1* 10/2015 Numaguchi ..... F04B 1/22 92/13

FOREIGN PATENT DOCUMENTS

CN 103306929 A 9/2013
EP 2 587 058 A1 5/2013
(Continued)

OTHER PUBLICATIONS

Korean-language Office Action issued in Korean Application No. 10-2019-7006276 dated Mar. 19, 2020 with English translation (11 pages).

(Continued)

*Primary Examiner* — Kenneth J Hansen
(74) *Attorney, Agent, or Firm* — Crowell & Moring LLP

(57) ABSTRACT

A nitriding layer (13) is formed on the front surface side of a base material of a cylinder block (7) including an opening side end surface (7B) and each cylinder hole (12). Then, a piston sliding surface (12A) of each cylinder hole (12) is formed as a compound layer-removed hole (17) by removing a compound layer (16) that is located on the front surface side of the nitriding layer (13) by using polishing means such as, for example, honing and so forth. Further, a compound layer-removed surface (18) is formed on a part (A) where a compound layer-removed hole (17) and a cylinder inlet side tapered surface (12B) of each cylinder hole (12) intersect by using the polishing means such as, for
(Continued)

example, the honing and so forth. This compound layer-removed surface (18) is formed as a tapered-state inclined surface of an angle α.

1 Claim, 4 Drawing Sheets

(51) Int. Cl.

| | |
|---|---|
| ***F04B 1/2064*** | (2020.01) |
| ***F04B 1/303*** | (2020.01) |
| ***F04B 1/2078*** | (2020.01) |
| ***F04B 1/12*** | (2020.01) |
| ***F04B 39/12*** | (2006.01) |
| ***F04B 1/03*** | (2020.01) |
| ***F04B 1/20*** | (2020.01) |
| ***C23C 8/24*** | (2006.01) |

(52) U.S. Cl.
CPC ..... *F04B 1/2064* (2013.01); *F04B 1/03* (2020.01); *F04B 1/12* (2013.01); *F04B 1/20* (2013.01); *F04B 1/2078* (2013.01); *F04B 1/303* (2013.01); *F04B 39/122* (2013.01); *F04B 39/126* (2013.01)

(58) Field of Classification Search
CPC .. F04B 39/126; F04B 1/03; F04B 1/20; F04B 1/303; C23C 8/24
See application file for complete search history.

(56) References Cited

FOREIGN PATENT DOCUMENTS

| | | | | |
|---|---|---|---|---|
| EP | 2587058 | A1 * | 5/2013 | ..... F04B 1/2021 |
| JP | 105675 | | 8/1981 | |
| JP | 58-111375 | U | 7/1983 | |
| JP | 2008-82325 | A | 4/2008 | |
| JP | 2008-106608 | A | 5/2008 | |
| JP | 2012-7509 | A | 1/2012 | |
| JP | 2013-185520 | A | 9/2013 | |

OTHER PUBLICATIONS

Extended European Search Report issued in counterpart European Application No. 17900272.0 dated Jan. 22, 2020 (eight (8) pages).
Chinese-language Office Action issued in counterpart Chinese Application No. 201780053807.3 dated Aug. 2, 2019 with English translation (eight (8) pages).
International Search Report (PCT/ISA/210) issued in PCT Application No. PCT/JP2017/039839 dated Jan. 23, 2018 with English translation (four (4) pages).
Japanese-language Written Opinion (PCT/ISA/237) issued in PCT Application No. PCT/JP2017/039839 dated Jan. 23, 2018 with English translation (three (3) pages).

* cited by examiner

AXIAL PISTON-TYPE HYDRAULIC ROTARY MACHINE

TECHNICAL FIELD

The present invention relates to an axial piston-type hydraulic rotary machine that is used as a hydraulic pump, a hydraulic motor in, for example, civil engineering machinery, construction machinery and other general machinery.

BACKGROUND ART

In general, a hydraulic rotary machine (for example, a fixed displacement type or variable displacement type axial piston-type hydraulic rotary machine) that is used as the hydraulic pump or the hydraulic motor in the construction machinery such as a hydraulic excavator and the general machinery is known. The axial piston-type hydraulic rotary machine of this kind according to conventional art is configured by including a casing, a rotational shaft that is rotatably provided in the casing, a cylinder block that is rotatably provided in the aforementioned casing so as to rotate together with the rotary shaft and in which a plurality of cylinder holes that are separated from one another in a circumferential direction and extend in an axial direction are formed and a plurality of pistons that are inserted and fitted into the respective cylinder holes in the cylinder block to be slidable and reciprocate in the respective cylinder holes with rotation of the cylinder block.

Here, the cylinder block that tapered chamfering is performed on the opening end (so-called entrance or inlet) side of each cylinder hole is known. That is, a tapered-state chamfered part is formed on the inlet side of each cylinder hole so as to restrain a piston that reciprocates in the cylinder hole from coming into friction contact with the inlet side of the cylinder hole with the aid of the aforementioned chamfered part and thereby sliding resistance of the both can be reduced (Patent Document 1).

According to another conventional art, the cylinder block that a base material of which is formed by using a cast, a steel material is known. A nitriding layer that is made by performing, for example, nitride-based heat treatment is formed on the front surface side of this base material. That is, the nitriding layer is formed on each cylinder hole in the cylinder block and its opening side end surface. Such a nitriding layer is configured by a diffusion layer that is formed on the front surface side of the base material and a compound layer that covers the front surface side of the diffusion layer and is formed as a layer that is harder than the diffusion layer (Patent Document 2).

PRIOR ART DOCUMENT

Patent Document

Patent Document 1: Japanese Patent Application Laid-Open No. 2008-106608 A

Patent Document 2: Japanese Patent Application Laid-Open No. 2012-7509 A

SUMMARY OF THE INVENTION

Incidentally, in the conventional art according to the above-mentioned Patent Document 2, honing is performed on each cylinder hole in the cylinder block thereby to remove a compound layer on a cylinder hole inner circumferential surface (that is, a piston sliding surface). However, there are cases where the high-hardness compound layer remains on the opening end (the inlet) side of the cylinder hole. Consequently, there is a problem that the piston that reciprocates in each cylinder hole is worn down and damaged by the compound layer that remains on the inlet side.

In addition, the conventional art according to the aforementioned Patent Document 1 forms the tapered-state chamfered part on the inlet side of each cylinder hole. It becomes possible to suppress friction contact of the piston that reciprocates in the cylinder hole with the inlet side of the cylinder hole with the aid of this chamfered part. However, this conventional art simply performs chamfering.

The present invention has been made in view of the above-described problems of the conventional art and an object of the present invention is to provide an axial piston-type hydraulic rotary machine configured to suppress wear and damage on a contact part between each cylinder hole of the cylinder block and the piston and thereby to make it possible to improve durability and life thereof.

In order to solve the above-described problems, the present invention is applied to an axial piston-type hydraulic rotary machine comprising: a tubular casing; a rotational shaft that is rotatably provided in the casing; a cylinder block that is provided in the casing so as to rotate together with the rotational shaft and has a plurality of cylinder holes that are separated from one another in a circumferential direction and extend in an axial direction; a plurality of pistons that are inserted and fitted into the respective cylinder holes in the cylinder block to be reciprocally movable; and a valve plate that is provided between the casing and the cylinder block and in which one pair of supply and exhaust ports that communicate with the respective cylinder holes are formed, wherein a cylinder inlet side tapered surface is formed on each of the cylinder holes in the cylinder block by performing cylinder inlet chamfering from an opening side end surface toward a piston sliding surface of the cylinder hole, and a nitriding layer on which nitride-based treatment is performed at least including the piston sliding surface, the opening side end surface of each of the cylinder holes and the cylinder inlet side tapered surface is formed on the cylinder block.

Then, the configuration adopted by the present invention is characterized in that: the piston sliding surface of each of the cylinder holes is formed as a compound layer-removed hole from which a compound layer that is located on the front surface side of the nitriding layer is removed and a compound layer-removed surface from which the compound layer that is located on the front surface side of the nitriding layer is removed is formed on apart where the compound layer-removed hole and the cylinder inlet side tapered surface of each of the cylinder holes intersect.

According to the present invention, an inner circumferential surface (the piston sliding surface) of each cylinder hole is formed as the compound layer-removed hole from which the compound layer is removed. Then, the compound layer-removed surface from which the compound layer that is located on the front surface side of the aforementioned nitriding layer is removed is formed on the part where the aforementioned compound layer-removed hole and the cylinder inlet side tapered surface intersect. Compound layer removal machining is performed in a piston sliding range over the inner circumferential surface (the piston sliding surface) and the inlet side of each cylinder hole in this way and thereby the wear when the piston slides can be suppressed.

MODE FOR CARRYING OUT THE INVENTION

In the following, an axial piston-type hydraulic rotary machine according to embodiments of the present invention will be described in detail by giving a case of applying it to a variable displacement-type inclined shaft-type hydraulic pump by way of example while referring to the appended drawings.

Figure 1:
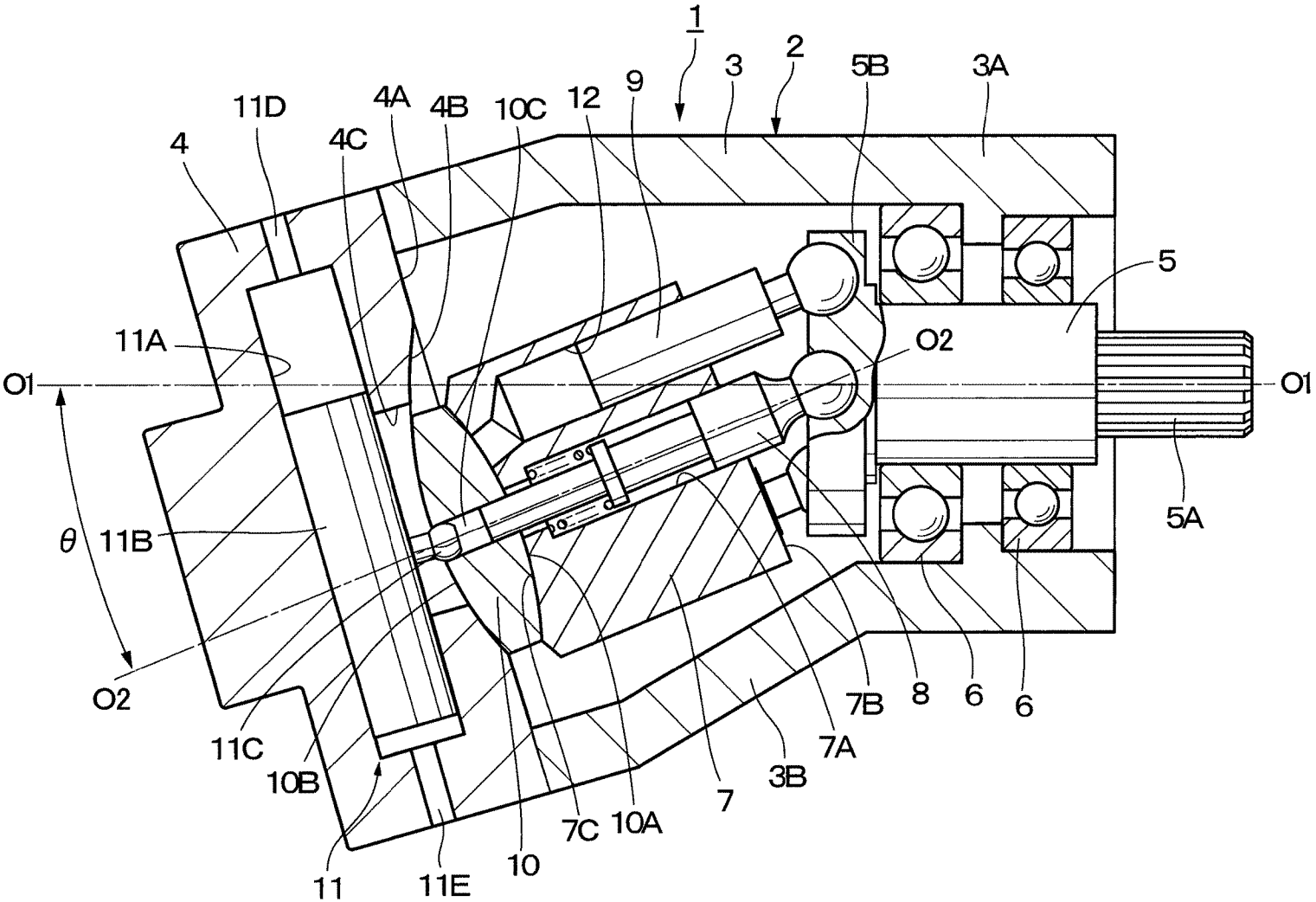
FIG. 1 is a longitudinal sectional diagram showing a variable displacement-type inclined shaft-type hydraulic pump according to a first embodiment of the present invention.

Here, FIG. 1 to FIG. 5 show a first embodiment of the present invention. In FIG. 1, a hydraulic pump 1 that is configured by a variable displacement-type inclined shaft-type hydraulic rotary machine has a casing 2 that configures an outer shell thereof. This casing 2 is configured by a casing body 3 that exhibits a bent tubular shape and a later described head casing 4. The hydraulic pump 1 supplies pressurized oil toward various kinds of hydraulic equipment (none of them are shown) that are connected on the downstream side of a hydraulic conduit while sucking hydraulic oil from a hydraulic oil tank.

The casing body 3 of the casing 2 is configured by a bearing part 3A that is located on one side of an axial direction and is formed into an almost cylindrical shape and a cylinder block accommodating part 3B that incliningly extends from the other end of the bearing part 3A. The head casing 4 is attached to the other end of this cylinder block accommodating part 3B. This head casing 4 is provided so as to close the axial-direction other side of the casing body 3, that is, the cylinder block accommodating part 3B from the other end side thereof.

The head casing 4 has a concave arc shape sliding contact surface 4B on a one-side surface 4A that is located on the casing body 3 side. This concave arc shape sliding contact surface 4B is formed as a concave arc surface that is formed along a rocking radius when a valve plate 10 rocks with a later described center shaft 8 being set as a fulcrum. An opening 4C for pin that communicates with a later described piston sliding bore 11A is opened in the concave arc shape sliding contact surface 4B. This opening 4C for pin is an opening adapted to allow displacement of a rocking pin 11C of a later described tilting mechanism 11 and extends along the piston sliding bore 11A. The piston sliding bore 11A in the tilting mechanism 11 is formed at a position located on the inner side of the concave arc shape sliding contact surface 4B of the head casing 4. Further, a suction flow passage and a delivery flow passage (none of them are shown) that extend from the concave arc shape sliding contact surface 4B toward mutually opposite sides with the piston sliding bore 11A being interposed therebetween are provided in the head casing 4.

A rotational shaft 5 is provided in the bearing part 3A of the casing body 3 to be rotatable having a rotational axis O1-O1. This rotational shaft 5 is rotatably supported to the bearing part 3A via a bearing 6 and its one side that is the projection side is made into a spline part 5A. On the other hand, a disc-shape drive disc 5B is formed integrally with the rotational shaft 5, being located on a leading end on the side of insertion into the casing body 3, that is, on the axial-direction other end thereof.

A cylinder block 7 is rotatably provided in the casing 2 (that is, in the cylinder block accommodating part 3B of the casing body 3). This cylinder block 7 is coupled to the drive disc 5B via a center shaft 8, each piston 9 and so forth that will be described later and rotates integrally with the rotational shaft 5. Here, the cylinder block 7 is formed into a thick cylindrical shape and a center hole 7A is provided in its center along a rotational axis O2-O2. In addition, a plurality (only one of them is shown in FIG. 1) of later described cylinder holes 12 are formed in the cylinder block 7, being located around the center hole 7A.

Here, the cylinder block 7 is, nitride-based treatment is performed on a later described base material 14 that is formed by using, for example, a cast, an iron-based material such as a steel material and so forth as surface treatment. An end surface on the axial-direction one side of the cylinder block 7 is made into an opening side end surface 7B of each cylinder hole 12 and each cylinder hole 12 is axially pierced in the cylinder block 7 with this opening side end surface 7B serving as an inlet. The cylinder block 7 is, an end surface on the axial-direction other side that is the side of a later described valve plate 10 is made into a sliding contact end surface 7C and this sliding contact end surface 7C is formed into a concave spherical shape to be sliding-contactable with a switching surface 10A of the valve plate 10.

The center shaft 8 is fully inserted into the center hole 7A in the cylinder block 7. This center shaft 8 is adapted to support the cylinder block 7 between the drive disc 5B of the rotational shaft 5 and the valve plate 10 in such a manner that it freely tilts. The center shaft 8 is coupled to a rotation center position of the drive disc 5B of the rotational shaft 5 to be rockable on its one end side and is inserted into a shaft hole 10C in the valve plate 10 on its other end side that projects from the sliding contact end surface 7C.

The plurality of pistons 9 are inserted and fitted into the respective cylinder holes 12 in the cylinder block 7 to be reciprocally movable respectively. These pistons 9 are coupled to the drive disc 5B of the rotational shaft 5 to be rockable on their one end sides that project from the cylinder holes 12. The cylinder block 7 that tilts relative to the rotational shaft 5 rotates and thereby each piston 9 repeats reciprocation in the cylinder hole 12. That is, each piston 9 sequentially repeats a suction stroke and a delivery stroke of hydraulic oil by sliding and displacing the cylinder hole 12. Incidentally, surface treatment including nitriding that is almost the same as that on the cylinder block 7 or heat treatment other than nitride-based treatment is performed on the piston 9 for the purpose of increasing the surface hardness and thereby to make improvement of wear resistance of the piston 9 possible.

The valve plate 10 is provided between the head casing 4 and the cylinder block 7. This valve plate 10 has a rectangular outer shape that falls within a width dimension (a lateral direction dimension that is vertical to a tilting direction) of the concave arc shape sliding contact surface 4B. The valve plate 10 is disposed in the concave arc shape sliding contact surface 4B of the head casing 4 to be tiltable. The convex spherical shape switching surface 10A that comes into sliding contact with the sliding contact end surface 7C of the cylinder block 7 in a surface contact state is provided on a one-side surface of the valve plate 10. On the other hand, an other-side surface of the valve plate 10 that is located on the opposite side of the switching surface 10A is made into a convex arc shape sliding contact surface 10B that projects with an arc that corresponds to that of the concave arc shape sliding contact surface 4B of the head casing 4 and comes into sliding contact with the concave arc shape sliding contact surface 4B.

In addition, the shaft hole 10C that is located at the center of the switching surface 10A and is pierced through the valve plate 10 in its plate thickness direction (an axial direction) is provided in the valve plate 10. The other end side of the center shaft 8 is inserted into this shaft hole 10C. Further, one pair of supply and exhaust ports, that is, a suction port and a delivery port (none of them are shown) that communicates with each cylinder hole 12 in the cylinder block 7 are provided in the valve plate 10. These ports are opened in the switching surface 10A on their one sides and are opened in the convex arc shape sliding contact surface 10B on their other sides.

The tilting mechanism 11 is provided in the head casing 4. This tilting mechanism 11 is adapted to tilt the valve plate 10 together with the cylinder block 7. The tilting mechanism 11 is configured by including a piston sliding bore 11A that is located on the side that is more inward than the innermost part of the concave arc shape sliding contact surface 4B and linearly extends along a tilting direction of the valve plate 10, a servo piston 11B that is inserted and fitted into the piston sliding bore 11A to be slidable, a rocking pin 11C that is provided on a length-direction intermediate part of the servo piston 11B and projects and extends from the servo piston 11B in a radial direction, and oil passage holes 11D, 11E that are provided on the both end sides of the aforementioned piston sliding bore 11A. The aforementioned rocking pin 11C is fully inserted into the opening 4C for pin in the head casing 4 and a leading end thereof is inserted into the shaft hole 10C in the valve plate 10.

Here, pressurized oil (a tilting control pressure) is supplied into the piston sliding bore 11A through the oil passage hole 11D or the oil passage hole 11E and thereby the servo piston 11B moves along this piston sliding bore 11A. When the servo piston 11B moves in this way, it becomes possible to tilt the valve plate 10 together with the cylinder block 7 via the rocking pin 11C. Thereby, the tilting mechanism 11 is able to adjust a tilt angle θ between the cylinder block 7 and the valve plate 10 relative to the rotational shaft 5 between a minimum tilt position and a maximum tilt position.

Figure 2:
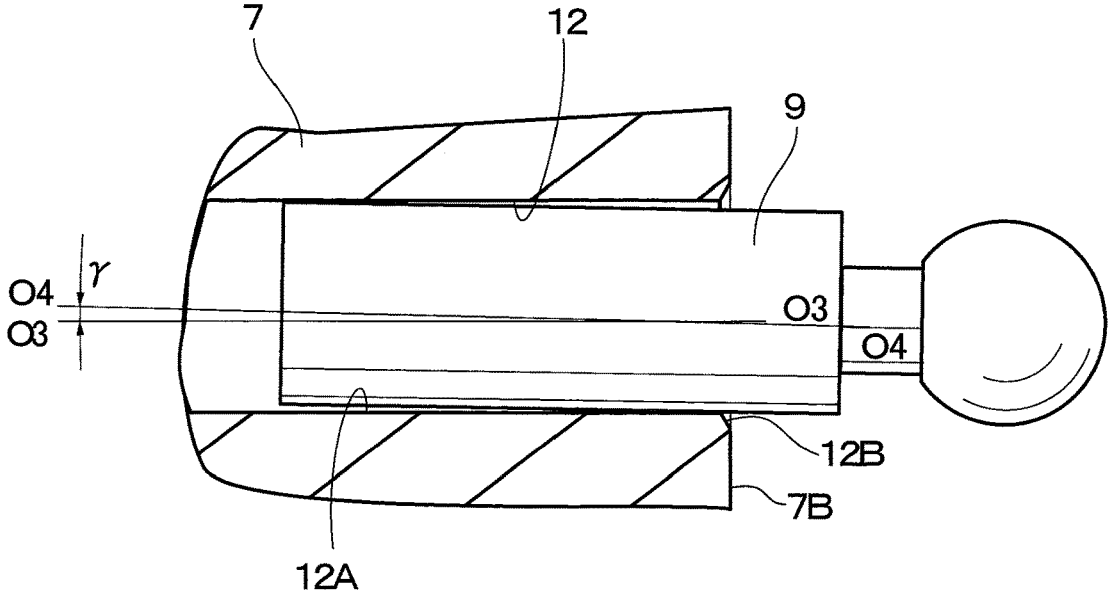
FIG. 2 is an enlarged sectional diagram showing a piston and a cylinder hole in a cylinder block in FIG. 1 in an enlarged state.
Figure 3:
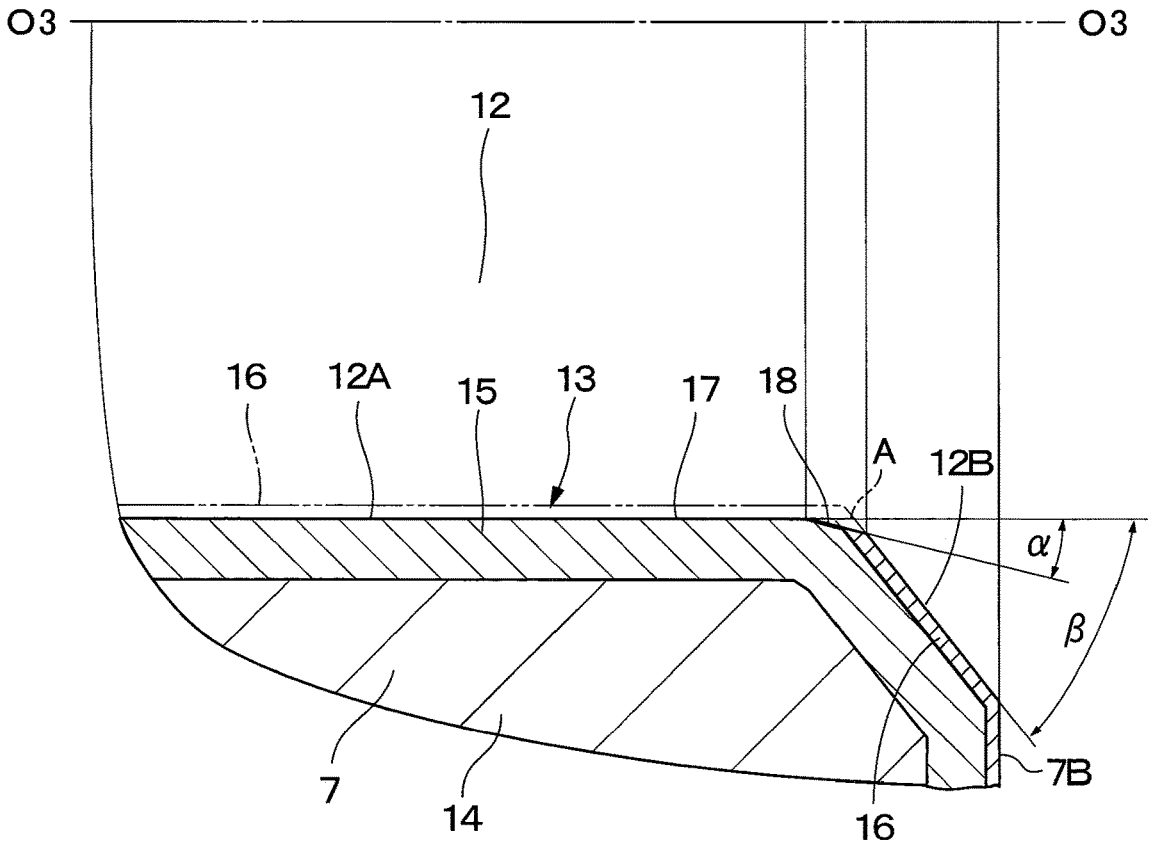
FIG. 3 is a sectional diagram of an inlet part showing a state where the cylinder hole in FIG. 2 is formed as a compound layer-removed hole in the enlarged state.

For example, five, seven or nine (in general, an odd number of) cylinder holes 12 are provided in the cylinder block 7. These cylinder holes 12 are separated from one another at fixed intervals in a circumferential direction around the center hole 7A and are formed so as to extend in the axial direction of the cylinder block 7. Each cylinder hole 12 has a piston sliding surface 12A along which the piston 9 is inserted and fitted thereinto to be slidable and a cylinder inlet side tapered surface 12B that is located on the inlet side thereof as shown in FIG. 2. Each cylinder hole 12 has a center axis O3-O3 as shown in FIG. 2.

The cylinder inlet side tapered surface 12B of each cylinder hole 12 is formed by performing cylinder inlet chamfering from the opening side end surface 7B of the cylinder block 7 toward an inner circumferential surface (that is, the piston sliding surface 12A) of the cylinder hole 12. The cylinder inlet side tapered surface 12B is formed so as to expand with a taper angle β relative to the center axis O3-O3 of the cylinder hole 12. This taper angle β is set to an angle of, for example, 10 to 45 degrees.

Figure 4:
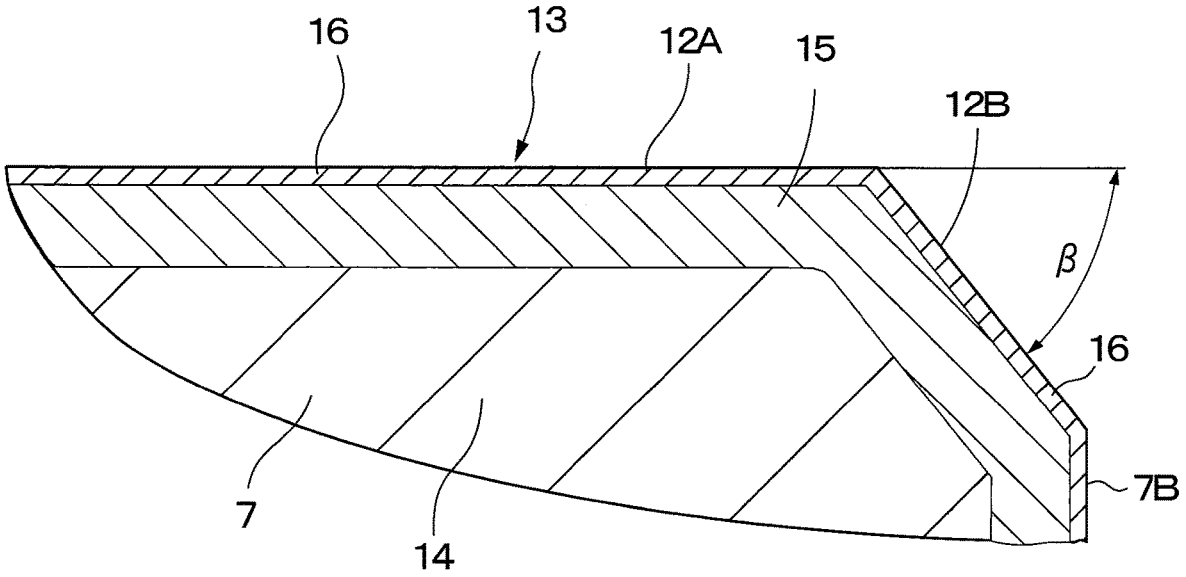
FIG. 4 is an essential part sectional diagram showing the cylinder hole in a state where a nitriding layer is formed in the enlarged state.

A nitriding layer 13 is formed on the front surface side of the cylinder block 7 by performing nitride-based heat treatment thereon as shown in FIG. 4. This nitriding layer 13 is formed so as to entirely cover the front surface side of the cylinder block 7, including the center hole 7A, the opening side end surface 7B, the sliding contact end surface 7C and the plurality of cylinder holes 12. That is, the nitriding layer 13 is configured by performing the nitride-based heat treatment on the base material 14 of the cylinder block 7 that is formed by using, for example, the cast, the iron-based material such as the steel material and so forth from the front surface side thereof.

Here, the nitriding layer 13 is configured by a diffusion layer 15 that is formed by performing nitriding on the front surface side of the base material 14 and a compound layer 16 that is formed so as to cover the front surface side of the diffusion layer 15 as shown in FIG. 4. The compound layer 16 is formed as a layer that is harder than the diffusion layer 15 in them and a thickness of the compound layer 16 is, for example, about 10 to 20 μm. In contrast, the diffusion layer 15 is formed on the lower layer side (or the inner side) of the compound layer 16 having a thickness of, for example, about 0.5 to 1.0 mm.

A compound layer-removed hole 17 is formed in the piston sliding surface 12A of the cylinder hole 12. This compound layer-removed hole 17 is formed by removing the compound layer 16 that is located on the front surface side of the nitriding layer 13 that is formed on the piston sliding surface 12A by using polishing means such as, for example, honing and so forth. That is, the compound layer-removed hole 17 is, the compound layer 16 (shown by virtual lines in FIG. 3, FIG. 5) that is located on the front surface side of the piston sliding surface 12A is removed by the polishing means over the entire circumference.

Figure 5:
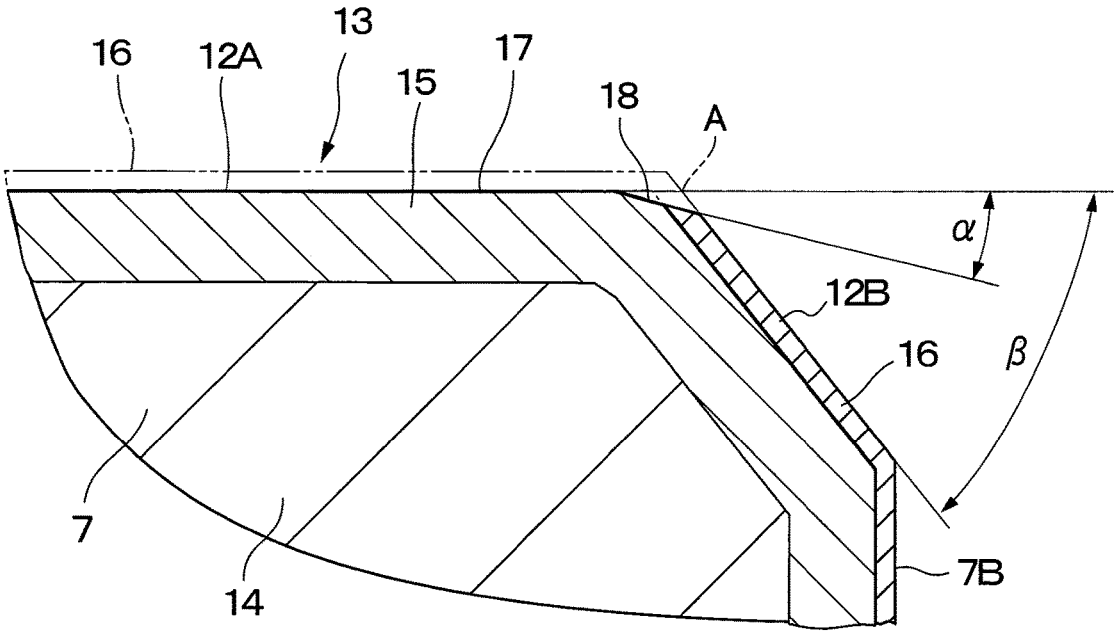
FIG. 5 is an essential part sectional diagram showing a state where a compound layer-removed hole and a compound layer-removed surface are formed in and on the nitriding layer in FIG. 4 in the enlarged state.

A compound layer-removed surface 18 is formed on a part A (that is, a piston contact point A that is shown by a virtual line in FIG. 5) where the compound layer-removed hole 17 and the cylinder inlet side tapered surface 12B of each cylinder hole 12 intersect and the compound layer 16 that is located on the front surface side is obliquely removed on this part A. That is, the compound layer-removed surface 18 is machined into a tapered state by the polishing means such as, for example, the honing and so forth in such a manner that the part A where the compound layer-removed hole 17 and the cylinder inlet side tapered surface 12B intersect is made into an inclined surface of an angle α. The part A where the compound layer-removed hole 17 and the cylinder inlet side tapered surface 12B intersect is obliquely scraped off by the compound layer-removed surface 18 and is made into the inclined surface of the angle α.

Here, when a taper angle of the cylinder inlet side tapered surface 12B is β and a maximum inclination angle of the piston 9 is γ, the angle α of the compound layer-removed surface 18 is set to satisfy a relation in the following formula 1. That is, the aforementioned angle α is set to an angle that is larger than the maximum inclination angle γ and is not more than the taper angle β. The maximum inclination angle γ means a maximum inclination angle that a dimensional tolerance on the basis of which the piston 9 is able to obliquely incline in the cylinder hole 12 is taken into consideration as shown in FIG. 2.

$$\gamma<\alpha\leq\beta \quad \text{[Formula 1]}$$

Here, the maximum inclination angle $\gamma$ is set to an angle of about 0.1 to 2 degrees. The taper angle $\beta$ of the cylinder inlet side tapered surface 12B is set to an angle of, for example, about 10 to 45 degrees. Therefore, the angle $\alpha$ of the compound layer-removed surface 18 is in an angle range of 1 to 45 degrees and is preferably set to an angle of 2 to 30 degrees.

The inclined shaft-type hydraulic pump 1 according to the first embodiment has such a configuration as mentioned above and, in the following, the operation thereof will be described.

First, the pressurized oil for tilting control is supplied from a pilot pump (not shown) into the piston sliding bore 11A in the tilting mechanism 11 via either one of the oil passage holes 11D, 11E. Thereby, the servo piston 11B slides and displaces in the piston sliding bore 11A and the valve plate 10 is moved to a desired tilt position together with the cylinder block 7. At this time, the tilt angel $\theta$ between the cylinder block 7 and the valve plate 10 that is a crossing angle between the rotational axis O1-O1 of the rotational shaft 5 and the rotational axis O2-O2 of the cylinder block 7 is variably controlled between the minimum tilt position and the maximum tilt position by the tilting mechanism 11.

A delivery amount (a flow rate) of the pressurized oil by the hydraulic pump 1 is determined depending on the tilt angle $\theta$ between the cylinder block 7 and the valve plate 10 relative to the rotational shaft 5. That is, the delivery amount of the hydraulic pump 1 is minimized at the minimum tilt position where the tilt angle $\theta$ is minimized and the delivery amount of the hydraulic pump 1 is maximized at the maximum tilt position where the tilt angle $\theta$ is maximized.

Next, when the rotational shaft 5 is rotationally driven by a motor (not shown) such as an engine and so forth, the cylinder block 7 rotates together with the drive disc 5B of the rotational shaft 5. The pistons 9 reciprocate respectively in the respective cylinder holes 12 with rotation of the cylinder block 7. Here, an oily liquid is sucked into the cylinder hole 12 via the aforementioned suction passage of the head casing 4, the aforementioned suction port of the valve plate 10 in the suction stroke of each piston 9 that reciprocates. The pressurized oil is delivered out of the cylinder hole 12 and this pressurized oil can be supplied toward the hydraulic equipment via the aforementioned delivery port of the valve plate 10, the aforementioned delivery passage of the head casing 4 in the delivery stroke of each piston 9.

Next, a manufacturing process of the cylinder block 7 will be described.

First, the cylinder block 7 is molded by using means such as casting and so forth from the base material 14 that is configured by, for example, the cast, the iron-based material such as the steel material and so forth. Cutting work for rough finishing is performed on the base material 14 of the cylinder block 7 as required. Next, the nitriding layer 13 that is made by performing, for example, the nitride-based heat treatment is formed on the front surface side of the base material 14. This nitriding layer 13 is formed as a surface treatment layer so as to entirely cover the front surface side of the cylinder block 7, including the center hole 7A, the opening side end surface 7B, the sliding contact end surface 7C and the plurality of cylinder holes 12.

Then, polishing for removing the compound layer 16 that is located on the front surface side of the nitriding layer 13 is performed on the piston sliding surface 12A of each cylinder hole 12 by using the polishing means such as, for example, the honing and so forth. Thereby, the piston sliding surface 12A of each cylinder hole 12 is formed as the compound layer-removed hole 17.

Further, the polishing for removing the compound layer 16 that is located on the front surface side of the nitriding layer 13 is performed on the part A (that is, the piston contact point A shown by the virtual line in FIG. 5) where the compound layer-removed hole 17 and the cylinder inlet side tapered surface 12B of each cylinder hole 12 intersect similarly by using the polishing means such as the honing and so forth. Thereby, the tapered-state inclined surface of the angle $\alpha$ is formed on the part A where the compound layer-removed hole 17 and the cylinder inlet side tapered surface 12B intersect as the compound layer-removed surface 18.

The part where the compound layer-removed hole 17 and the cylinder inlet side tapered surface 12B intersect is polished into the tapered-state inclined surface of the angle $\alpha$ as the compound layer-removed surface 18 in this way in the first embodiment. Thereby, the wear when the piston 9 comes into contact with the inlet side (that is, the part where the compound layer-removed hole 17 and the cylinder inlet side tapered surface 12B intersect) of the cylinder hole 12 is reduced to make it possible to improve the durability and the life thereof.

Incidentally, in a case where the compound layer-removed surface 18 is not formed in the vicinity of the part A where the compound layer-removed hole 17 and the cylinder inlet side tapered surface 12B intersect, there is the possibility that such a problem as described below would occur.

That is, when the rotational shaft 5 of the hydraulic pump 1 is rotationally driven by the engine, this rotation is transmitted from the drive disc 5B to the cylinder block 7 via the plurality of pistons 9. The plurality of pistons 9 come into contact with the inlet sides of the respective cylinder holes 12 and transmit loads thereto in this rotation transmission. At this time, the piston 9 inclines relative to each cylinder hole 12 in a range of, for example, the maximum inclination angle $\gamma$ shown in FIG. 2. In addition, the load that is rotationally transmitted from each piston 9 to the cylinder block 7 is determined depending on the load that is needed to drive a hydraulic actuator (not shown) that is connected to the delivery side of the hydraulic pump 1.

However, in a case where the inlet side of the piston sliding surface 12A of each cylinder hole 12 is in the form of an edge shape, an area when the piston 9 comes into contact with this part results in contact of a small area. Therefore, a contact part of the small area reaches a high contact surface pressure and there is concern about the wear of the piston 9 surface. Further, in a case where compound layer removing is performed on the piston sliding surface 12A of the cylinder hole 12 by the honing and so forth after nitriding, the high-hardness compound layer 16 remains on the inlet side (that is, the part A where the compound layer-removed hole 17 and the cylinder inlet side tapered surface 12B intersect) of each cylinder hole 12. Therefore, when the piston 9 comes into contact with the inlet side of the cylinder hole 12, for example, the piston 9 is, the wear becomes liable to occur on its contact part.

It follows that the plurality of pistons 9 repeat reciprocation (sliding contact) along the inner circumferential surfaces (the piston sliding surfaces 12A) of the respective cylinder holes 12 while rotationally driving the cylinder block 7 of the hydraulic pump 1 together with the rotational shaft 5 in such a state. Therefore, sliding surfaces of each piston 9 and the cylinder hole 12 become liable to be worn down and improvement thereof is desired.

In addition, the conventional art according to aforementioned Patent Document 1 simply performs chamfering without performing nitriding and so forth on the base material of the cylinder block and no consideration is given to removing and so forth of the compound layer. Therefore, it is difficult to improve the durability and the life of the piston.

Accordingly, the base material 14 of the cylinder block 7 is formed by using the cast, the steel material and so forth and the nitriding layer 13 that is made by performing, for example, nitride-based heat treatment is formed on the front surface side of the base material 14 in the first embodiment. This nitriding layer 13 is formed to entirely cover the front surface side of the cylinder block 7, including the center hole 7A, the opening side end surface 7B, the sliding contact end surface 7C and the plurality of cylinder holes 12. Then, the piston sliding surface 12A of each cylinder hole 12 is formed as the compound layer-removed hole 17 by removing the compound layer 16 that is located on the front surface side of the nitriding layer 13 by using the polishing means such as, for example, the honing and so forth.

Further, the compound layer-removed surface 18 is formed on the part A (that is, the piston contact point A shown by the virtual line in FIG. 5) where the compound layer-removed hole 17 and the cylinder inlet side tapered surface 12B of each cylinder hole 12 intersect by using the polishing means such as, for example, the honing and so forth. That is, the part A where the compound layer-removed hole 17 and the cylinder inlet side tapered surface 12B intersect is obliquely scraped off by the compound layer-removed surface 18 and the compound layer-removed surface 18 is formed as the tapered-state inclined surface of the angle $\alpha$. The angle $\alpha$ of the compound layer-removed surface 18 is set to an angle that is larger than the maximum inclination angle $\gamma$ and is not more than the taper angle $\beta$ so as to satisfy the relation in the aforementioned formula 1 relative to the taper angle $\beta$ of the cylinder inlet side tapered surface 12B and the maximum inclination angle $\gamma$ of the piston 9.

The compound layer-removed surface 18 from which the compound layer 16 that is located on the front surface side of the nitriding layer 13 is removed is formed on the part A where the compound layer-removed hole 17 and the cylinder inlet side tapered surface 12B intersect in this way. Therefore, it is possible to prevent the high-hardness compound layer 16 from remaining on the opening end (inlet) side of each cylinder hole 12 with the aid of the compound layer-removed surface 18. As a result, it is possible to restrain the piston 9 that reciprocates in each cylinder hole 12 (the compound layer-removed hole 17) from being worn down and damaged on its inlet (the cylinder inlet side tapered surface 12B) side for a long period of time.

In other words, the piston sliding surface 12A of each cylinder hole 12 is made into the compound layer-removed hole 17 and thereafter the compound layer-removed surface 18 is formed in such a manner that the compound layer 16 does not remain in the vicinity of the piston contact point A shown in FIG. 5 in the first embodiment. Thereby, the wear when the piston 9 comes into contact with the inlet side of the cylinder hole 12 can be reduced. In addition, delamination and so forth of the compound layer 16 on the inlet side of each cylinder hole 12 can be suppressed.

Accordingly, the wear when the piston slides can be suppressed and the durability and life thereof can be improved by performing compound layer removal machining in a sliding range of the piston 9 over the inner circumferential surface (the piston sliding surface 12A) and the inlet side of each cylinder hole 12 according to the first embodiment. In addition, the contact area when the piston 9 comes into contact with the inlet side of the cylinder hole 12 can be made large and the contact surface pressure can be reduced by forming the compound layer-removed surface 18 as the tapered-state inclined surface of the angle $\alpha$.

Figure 6:
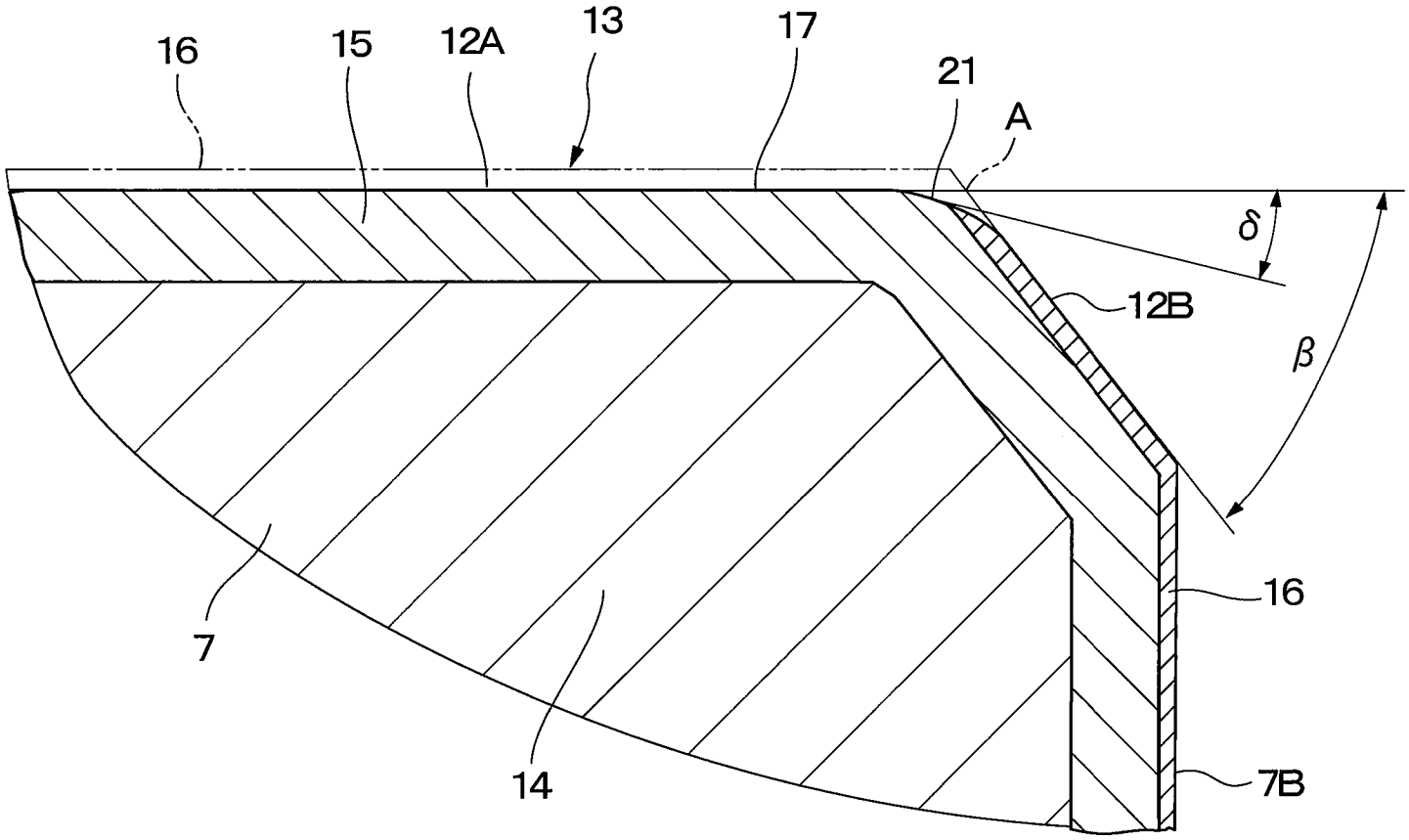
FIG. 6 is an essential part sectional diagram showing a compound layer-removed hole and a compound layer-removed surface that are formed in and on a cylinder block according to a second embodiment in the enlarged state.

Next, FIG. 6 shows a second embodiment of the present invention and the characteristic of the second embodiment lies in a configuration that a compound layer-removed surface is formed with a machined surface that is configured by a curved surface. Incidentally, the same symbol is assigned to the constitutional element that is the same as that in the first embodiment and description thereof is omitted in the present embodiment.

Here, a compound layer-removed surface 21 is adopted in place of the compound layer-removed surface 18 described in the aforementioned first embodiment. This compound layer-removed surface 21 is configured by forming the machined surface that is configured by a curved surface that is arc-shaped in section on the part A where the compound layer-removed hole 17 and the cylinder inlet side tapered surface 12B intersect by using the polishing means such as, for example, the honing and so forth.

That is, the compound layer-removed surface 21 is formed by abrasively machining the part A where the compound layer-removed hole 17 and the cylinder inlet side tapered surface 12B intersect into a curved-surface shape in such a manner that its angle $\delta$ is gradually widened. The angle $\delta$ of the compound layer-removed surface 21 is an angle that is gradually increased in multiple stages of two or more stages and is set so as to satisfy a relation in the following formula 2. That is, the angle $\delta$ in this case is set to an angle that is larger than the maximum inclination angle $\gamma$ and is not more than the taper angle $\beta$.

$$\gamma<\delta\leq\beta \qquad \text{[Formula 2]}$$

Thus, the piston sliding surface 12A of each cylinder hole 12 is formed as the compound layer-removed hole 17 by removing the compound layer 16 that is located on the front surface side of the nitriding layer 13 by using the polishing means such as, for example, the honing and so forth also in the second embodiment that is configured in this way. Then, the compound layer-removed surface 21 is formed on the part A where the compound layer-removed hole 17 and the cylinder inlet side tapered surface 12B of each cylinder hole 12 intersect by using the polishing means such as, for example, the honing and so forth.

The compound layer-removed surface 21 is formed by abrasively machining the part A where the compound layer-removed hole 17 and the cylinder inlet side tapered surface 12B intersect into the curved-surface shape in such a manner that its angle is gradually widened particularly in the second embodiment. For this reason, remaining of the high-hardness compound layer 16 on the opening end (the inlet) side of each cylinder hole 12 can be surely eliminated with the aid of the compound layer-removed surface 21. Thereby, it is possible to restrain the piston 9 that reciprocates in each cylinder hole 12 (the compound layer-removed hole 17) from being worn down and damaged on its inlet (the cylinder inlet side tapered surface 12B) side for the long period of time.

The contact area across which each piston 9 comes into contact with the inlet side of each cylinder hole 12 can be made large and the contact surface pressure of the piston 9 can be more reduced by forming the compound layer-removed surface 21 as the curved surface in such a manner that the angle thereof gradually changes starting from the inlet side of each cylinder hole 12 in this way.

Incidentally, description is made by giving a case of forming the compound layer-removed surface 21 as the curved surface by way of example in the aforementioned second embodiment. However, the present invention is not limited to this and the compound layer-removed surface may be formed as a plural-stage tapered-state inclined surface that is widened in a plurality of stages such as, for example, two to four stages.

In addition, description is made by giving the inclined shaft-type variable displacement-type hydraulic pump as an example of the axial piston-type hydraulic rotary machine in each of the aforementioned embodiments. However, the present invention is not limited to this and may be applied to, for example, a fixed displacement-type inclined shaft-type hydraulic pump, a fixed displacement-type or variable displacement-type inclined shaft-type hydraulic motor. Further, it may be also applied to fixed displacement-type or variable displacement-type swash plate-system hydraulic rotary machines (hydraulic pump, hydraulic motor).

DESCRIPTION OF REFERENCE NUMERALS

1: Hydraulic pump (Axial piston-type hydraulic rotary machine)
2: Casing
3: Casing body
4: Head casing
5: Rotational shaft
7: Cylinder block
7A: Center hole
7B: Opening side end surface
8: Center shaft
9: Piston
10: Valve plate
11: Tilting mechanism
12: Cylinder hole
12A: Piston sliding surface
12B: Cylinder inlet side tapered surface
13: Nitriding layer
14: Base material
15: Diffusion layer
16: Compound layer
17: Compound layer-removed hole
18, 21: Compound layer-removed surface
A: Part where the compound layer-removed hole and the cylinder inlet side tapered surface intersect
α: Angle
β: Taper angle
γ: Maximum inclination angle

The invention claimed is:

1. An axial piston-type hydraulic rotary machine comprising:

a tubular casing;

a rotational shaft that is rotatably provided in the casing;

a cylinder block that is provided in the casing so as to rotate together with the rotational shaft and has a plurality of cylinder holes that are separated from one another in a circumferential direction and extend in an axial direction;

a plurality of pistons, each piston of the plurality of pistons is inserted and fitted into a respective cylinder hole of the plurality of cylinder holes in the cylinder block to be reciprocally movable; and a valve plate that is provided between the casing and the cylinder block and in which one pair of supply and exhaust ports that communicate with the respective cylinder holes are formed, wherein a nitriding layer on which nitride-based treatment is performed at least including an opening side end surface and a piston sliding surface of each cylinder hole of the plurality of cylinder holes, the nitriding layer including a diffusion layer that is formed on a front surface side of a base material of the cylinder block and a compound layer that covers a front surface side of the diffusion layer, the compound layer being harder than the diffusion layer, wherein a cylinder inlet side tapered surface is formed on each of the cylinder holes in the cylinder block by a chamfer from the opening side end surface towards the piston sliding surface and the nitriding layer;

each of the cylinder holes has a compound layer-removed portion at which the compound layer is not present on a front surface side of the nitriding layer at the piston sliding surface of each of the cylinder holes and at which the diffusion layer is located on the front surface side, a compound layer-removed surface includes a part of each of the cylinder holes where the compound layer-removed portion and the cylinder inlet side tapered surface of each of the cylinder holes intersect at an oblique angle, the compound layer-removed surface is machined into a tapered state in such a manner that the part where the compound layer-removed portion and the cylinder inlet side tapered surface intersect at the oblique angle has an angle α, and when a taper angle of the cylinder inlet side tapered surface is β and a maximum inclination angle at which each piston obliquely inclines in the respective cylinder hole is γ, the angle α is larger than the maximum inclination angle γ and is not more than the taper angle β.

* * * * *